US005697815A

United States Patent [19]

Drewnicki

[11] Patent Number: 5,697,815

[45] Date of Patent: Dec. 16, 1997

[54] ELECTRICAL CONNECTORS

[76] Inventor: Richard Drewnicki, North Luffenham Hall, North Luffenham, nr. Oakham, Leicestershire, LE15 8JR, Great Britain

[21] Appl. No.: 604,923

[22] Filed: Feb. 22, 1996

[30] Foreign Application Priority Data

Jun. 7, 1995 [GB] United Kingdom ..... 9511513

[51] Int. Cl.[6] ..... H01R 23/02

[52] U.S. Cl. ..... 439/638; 439/676

[58] Field of Search ..... 439/638, 676, 439/344, 701

[56] References Cited

U.S. PATENT DOCUMENTS 4,241,974 12/1980 Hardesty .
4,438,998 3/1984 Myers ..... 439/638
4,444,451 4/1984 Myers ..... 439/638
4,714,440 12/1987 Hutchins ..... 439/676

FOREIGN PATENT DOCUMENTS 0 018 654 11/1980 European Pat. Off. .
WO 80/02475 11/1980 WIPO .

*Primary Examiner*—Gary F. Paumen
*Assistant Examiner*—Tho D. Ta
*Attorney, Agent, or Firm*—Gary M. Nath; Nath & Associates

[57] ABSTRACT

An electrical connector, particularly a telephone adaptor, comprising a plug portion and a socket portion, a plurality of electrical contacts on the plug portion, a plurality of corresponding electrical contacts in the socket portion, and a plurality of electrical conductors joining respective contacts on the plug portion and in the socket portion, each pair of contacts and its associated conductor consisting of a unitary wire member.

3 Claims, 6 Drawing Sheets

18
19
20
21
22
23
24
25
26
27
28
32
33
34

ELECTRICAL CONNECTORS

The invention relates to electrical connectors and more particularly, but not exclusively, to electrical connectors for interconnecting telephone apparatus.

It is known to provide an electrical connector for telephone apparatus and by which two articles of telephone apparatus can be connected to a single line. The known connector, often referred to as a double adaptor, comprises individual electrical conductors each of which is stamped, bent and twisted from a single piece of metal strip to form connecting terminals or contacts in a male plug portion of the adaptor and in a pair of female socket portions in the adaptor. Such an arrangement provides a considerable advance over previously known methods of making such adaptors employing separate connecting terminals or contacts which are joined together by conductors in the form of conventional electrical wires using soldering and/or crimping techniques.

It is an object of the invention to provide an electrical connector, e.g. a telephone double adaptor, of simple construction and assembly to reduce costs of manufacture.

According to the invention an electrical connector comprises a plug portion and at least one socket portion, a plurality of electrical contacts on or in the plug portion, a plurality of corresponding electrical contacts in the or each socket portion, and a plurality of electrical conductors joining respective contacts in the plug portion and in the or each socket portion, characterised in that each pair of contacts and its associated conductor is a unitary member formed from a length of wire.

Where the electrical connector comprises a pair of socket portions, the unitary member may be arranged such that its opposite end portions form contacts in both socket portions and an intermediate portion form a contact in the plug portion.

The wire will be of a kind which can be bent into a desired shape and which will retain that shape, or at least which will tend to regain that shape when resiliently deflected. The wire may be of any desired cross-sectional shape, e.g. round or square, and the contact portions may be plated to resist corrosion, e.g. gold plated, if desired.

Preferably the connector comprises a carrier member of an electrically insulating material, e.g. plastics, which supports a plurality of the unitary members. Preferably the carrier member is formed with grooves in which the unitary members, or at least portions thereof, are received and maintained in spaced relationship. The ends of each unitary member preferably overhang one end of the carrier member so that they form resiliently displaceable contacts. Preferably the wire of each unitary member is bent double to embrace the carrier member and is arranged with the ends disposed mutually adjacent.

Where the electrical connector is a double adaptor, the carrier member may be grooved on opposite sides to accept opposed limbs of the unitary members embracing the carrier member.

It will be appreciated that the spacings of the grooves on opposite sides may be different to adapt the connector to different standards, e.g. U.S. to U.K. In such an arrangement, it may be desirable to arrange the axes of the pair of sockets at right angles to minimise confusion.

The carrier member is preferably adapted to be received in a two-part housing, one part of which housing forms the plug portion in association with one end portion of the carrier member and the other part of which forms the socket portion or portions.

The invention is diagrammatically illustrated, by way of example, in the accompanying drawings, in which.

Figure 1:
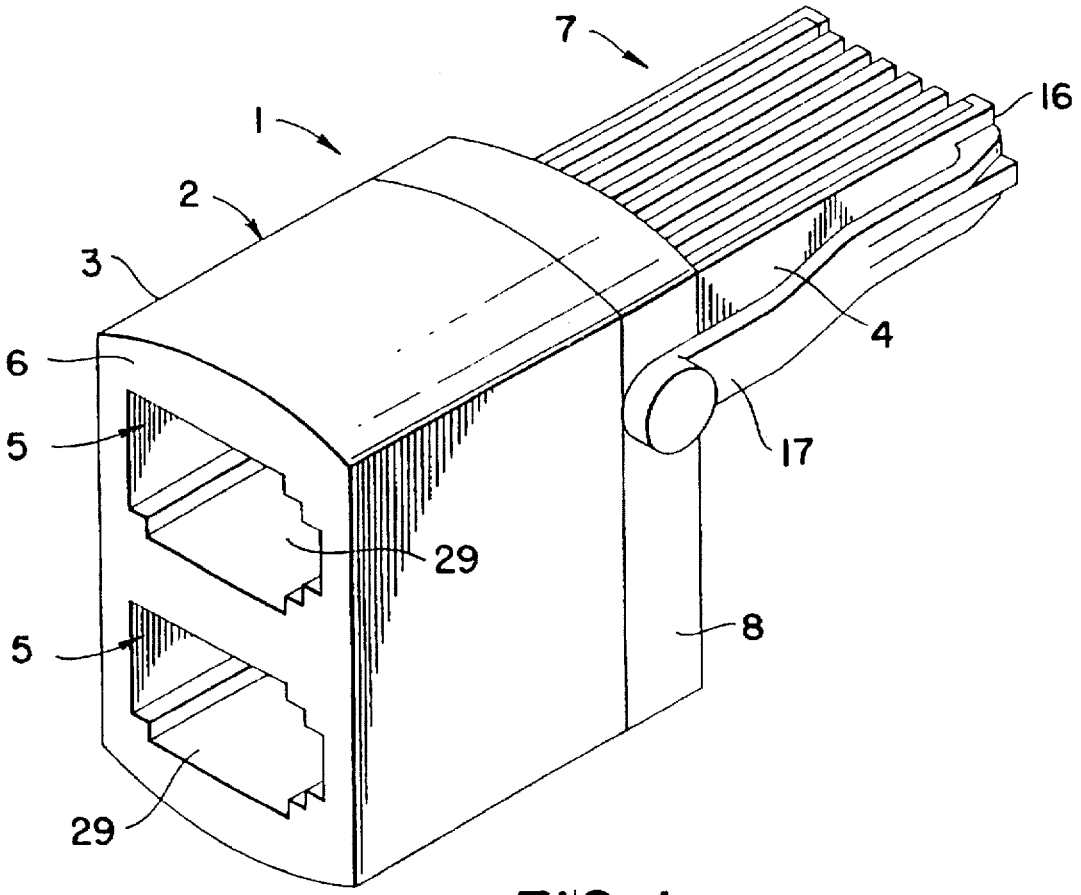
FIG. 1 is a perspective view of a first embodiment of electrical connector in the form of a single standard double telephone adaptor.
Figure 2:
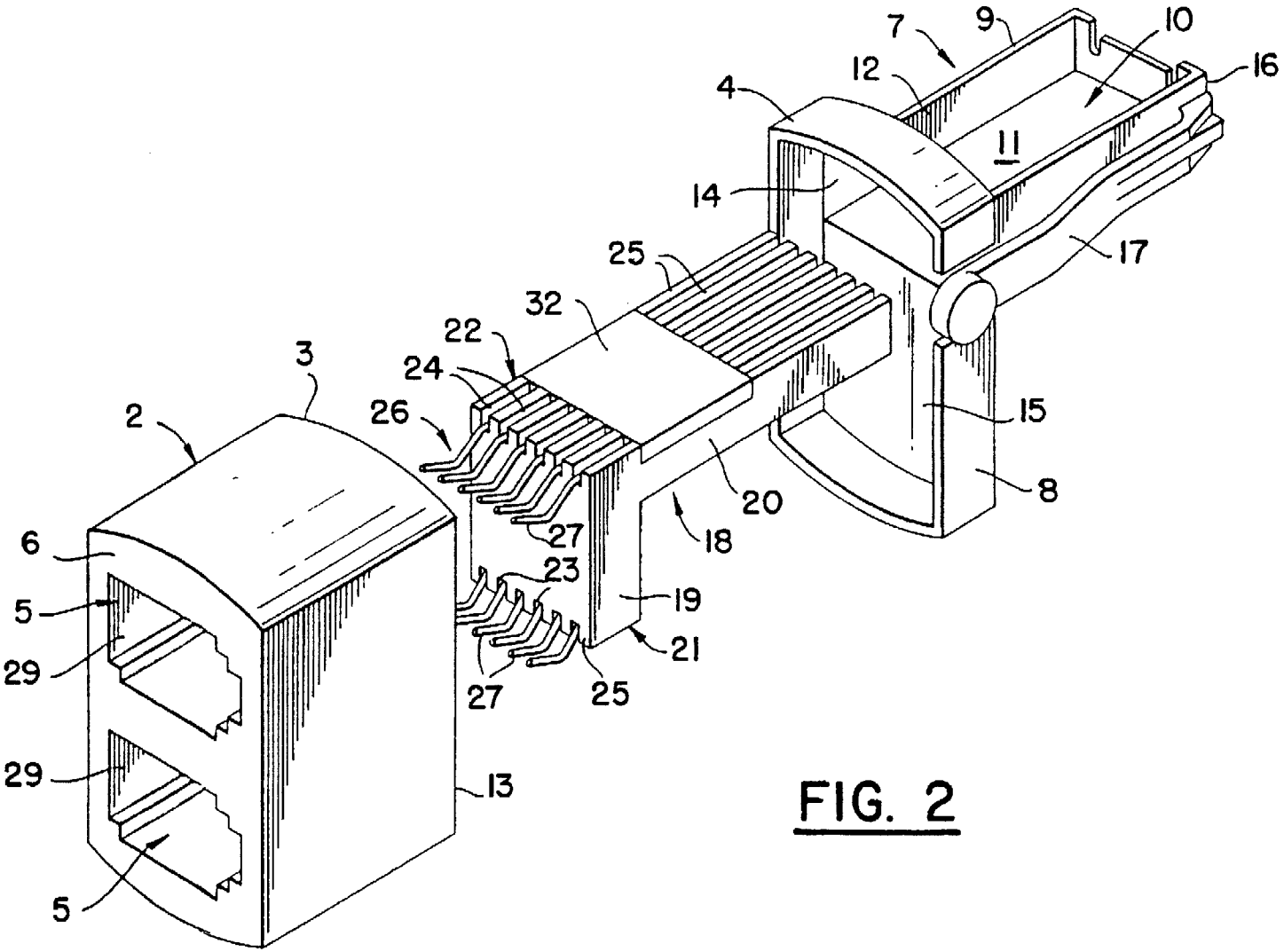
FIG. 2 is an exploded perspective view of the double-adaptor of FIG. 1.
Figures 3, 4A, 4B:
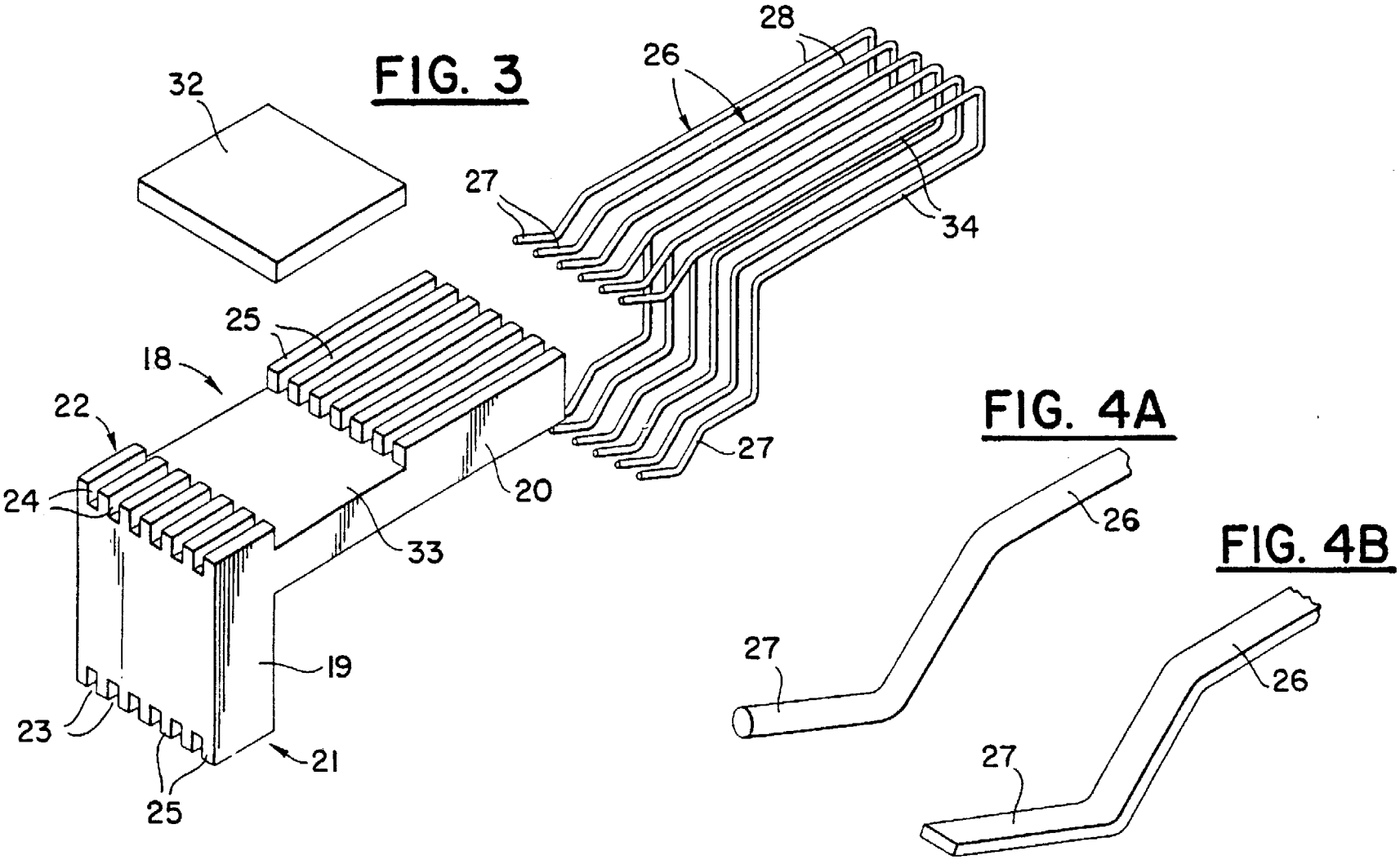
FIG. 3 is an exploded perspective view of a part of connector of FIG. 1.
Figure 5:
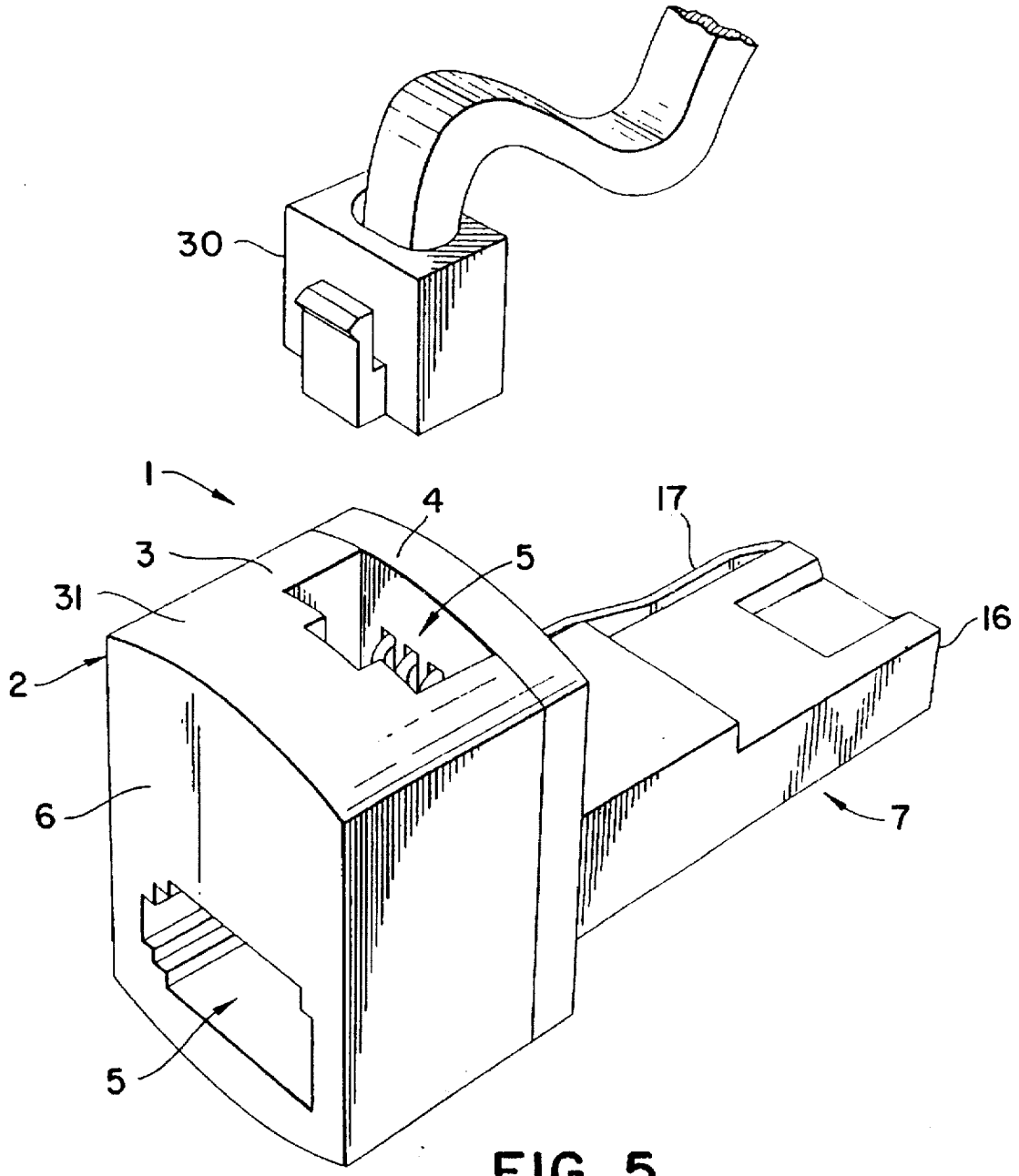
Figure 6:
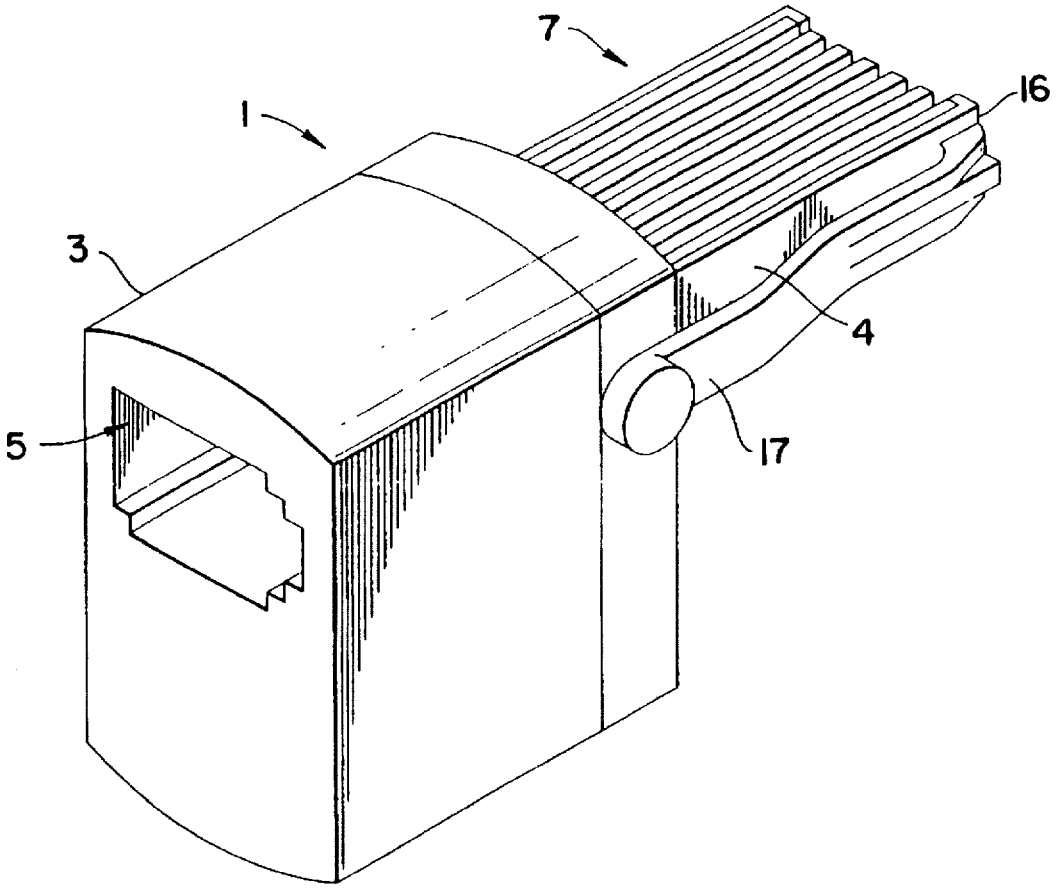

FIG. 4*a* and 4*h* are respective scrap views of a portion of the connector shown ringed in FIG. 3 and showing alternate embodiments;

FIG. 5 is a perspective view of a second embodiment of electrical connector in the form of a dual standard double telephone adaptor;

FIG. 6 is a further perspective view of the electrical connector of FIG. 5, and

Figure 7:
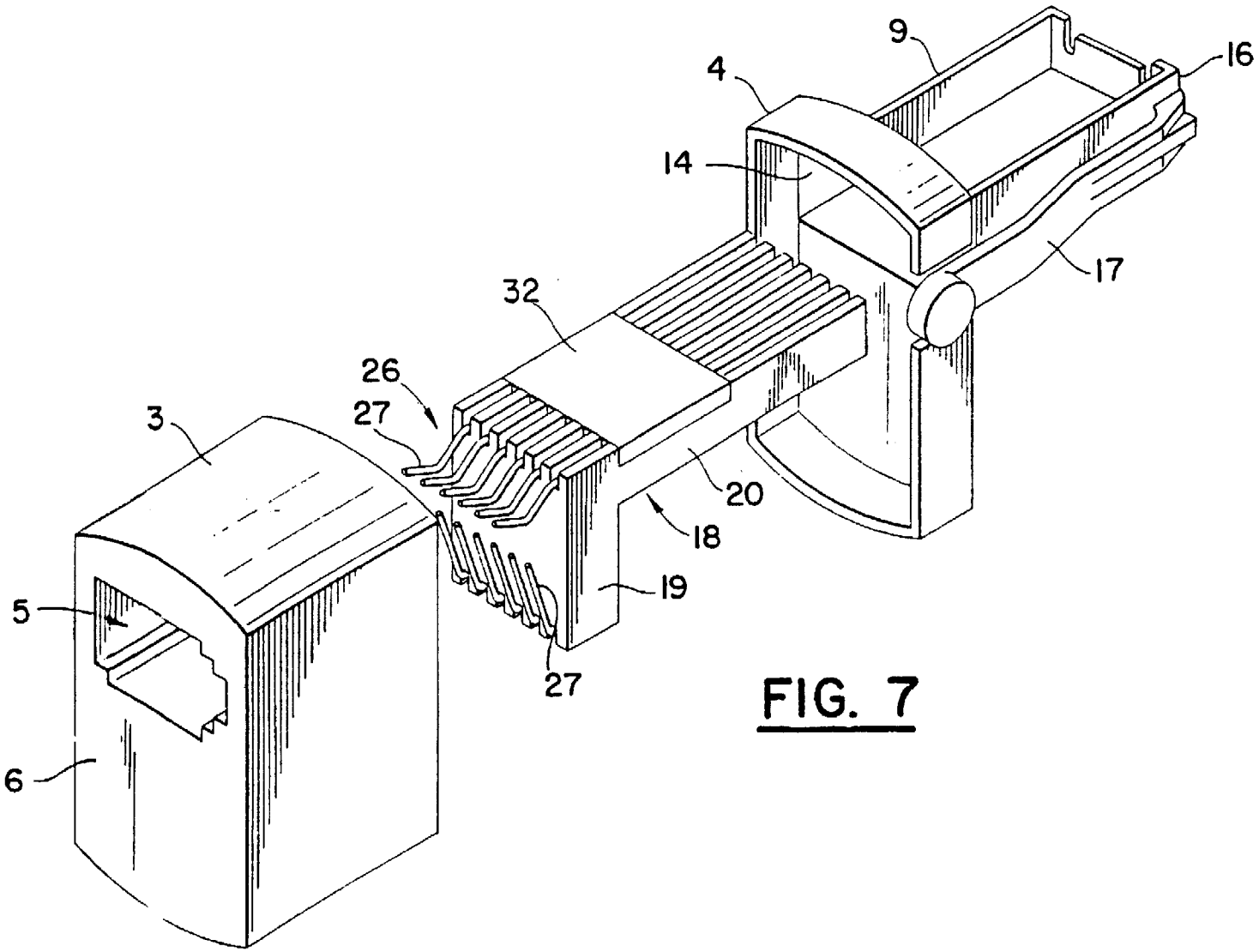

FIG. 7 is an exploded perspective view of the connector of FIG. 5.

Referring more particularly to FIGS. 1 to 4 of the drawings there is shown a single standard double telephone adaptor 1 comprising a housing 2 consisting of a first part 3 which is generally box-like and which defines a pair of socket apertures 5 in an end face 6, and a second part 4 which closes the box-like first part and which defines a plug portion 7. The interior of the first housing part 3 is formed to define socket portions 29. The two parts of the housing may be secured together in any desired manner, e.g. by snap-action connectors, or by screws or the like (not shown). Alternatively the two parts of the housing may be joined together by welding or by means of an adhesive.

The second part 4 of the housing comprises a closure member 8 shaped to correspond with an end 13 of the part 3 opposite to the end 6 and adapted to engage and close the housing part 3 and a projecting generally rectangular tray-like member 9, that is to say a flat generally rectangular plate-like portion 10, one face 11 of which is surrounded on three sides with a peripheral wall 12. The closure member 8 is formed with an aperture 14 in an end face 15, which aperture communicates with the interior of the tray-like member 9. The distal end 16 of the tray member 9 carries a manually actuable resilient catch 17, of a kind known per se.

A carrier member 18 is adapted to be received in the housing 2. The carrier member 18 is generally L-shaped and comprises two integrally connected generally rectangular portions 19, 20 of which portion 19 is arranged to be received in the box-like housing part 3 and of which the portion 20 is adapted to be received snugly in the tray-like member 9 of the second housing part 4. An end face 21 of the portion 19 is formed with a series of parallel grooves 23 and a face 22 of the portion 20 is formed with corresponding parallel grooves 24. The grooves 23 and 24 define opposed spacer members 25 for the purpose appearing below.

Generally U-shaped members 26, each of which is formed, e.g. by bending, from a single length of wire, are received on the carrier member 18 with opposite limbs 34 embracing the carrier member and are located in respective grooves 23 and 24 in the faces 21 and 22 so that the members 26 are electrically separate one from the other. The arrangement is such that each unitary wire member 26 has mutually adjacent opposed ends 27 overhanging from the portion 19 of the carrier member and an intermediate portion 28 embracing the portion 20 of the carrier member 18. The ends 27 of the unitary wire members 26 are bent to form resiliently displaceable electrical contacts positioned in the interior of the socket portions 29 of the adaptor 1 to make electrical contact with corresponding plugs (not shown). The intermediate portions 28 of the unitary wire members 26 form electrical contacts on the plug portion 7 of the adaptor 1 to make electrical contact with an electrical socket, e.g. a wall socket, (not shown).

The unitary wire members 26 are positively retained in the grooves in the carrier member 18 by means of a retainer plate 32 which is mounted in a recess 33 on the carrier member after assembly of the members 26 on the carrier member 18 to trap the members 26 in the grooves. The retainer plate 32 may be secured to the carrier member 18 in any convenient manner, e.g. by snap-action connectors (not shown) or by welding or my means of an adhesive.

The housing parts 3 and 4 and the carrier member 18 and retainer plate 32 are preferably moulded from an electrically insulating plastics material. The members 26 are made from electrically conductive resilient metal wire, which, as shown in FIGS. 4*a* and 4*a*, may be of any desired cross-section, e.g. circular or rectangular.

The adaptors depicted in FIGS. 5 to 7 are generally similar to that described above except that in each case the adaptor is arranged to accept plugs of two different standards, one of which is shown at 30, such adaptors normally being known as dual standard adaptors.

For this reason, one socket aperture 5 is positioned in the end face 6 of the housing 2, whereas the other socket aperture 5 is positioned in a side face 31 of the housing 2, to minimize the risk of confusion. This entails corresponding modification of the ends 27 of the unitary wire members 26 so that they extend generally at right angles one to the other, as can be seen in FIG. 7, to suit the right angles arrangement of the socket apertures 5.

The invention thus provides a simplified form of telephone adaptor which facilitates economical manufacture. An advantage of an electrical connector of the present invention compared to that of known connectors is that in making the unitary members from wire, no scrap is created as is the case when the members are stamped from strip metal and that they can be fabricated more rapidly and more cheaply than with the known connectors.

I claim:

1. An electrical double adaptor comprising:

a housing of electrically insulating material having a first part defining a plug portion and a second part defining a pair of socket portions, a generally L-shaped carrier member of electrically insulating material mounted in the housing to extend into the first and second parts and comprising an arm which partly defines the plug portion, and an arm which partly defines the socket portions, and having opposed sets of grooves on the respective arms, and a plurality of generally U-shaped unitary wire members, each of which comprises opposed limb portions, an adjacently disposed pair of free end portions and an intermediate portion, the intermediate portions of said unitary wire members defining electrical contacts on the plug portion, said end portions defining a plurality of corresponding electrical contacts in each socket portion, and the said unitary wire members defining electrical conductors joining respective contacts on the plug portion and in each socket portion, and wherein said unitary wire members are mounted on said carrier member with the opposed limb portions embracing the arms of the carrier member and disposed in said grooves whereby said unitary wire members are maintained in spaced relationship and with the opposite end portions disposed mutually adjacent and overhanging the carrier member to form resiliently displaceable contacts, and with the intermediate portions of the unitary wire members surrounding and supported by one of said arms.

2. An electrical double adaptor according to claim 1 wherein said first housing part comprises a tray adapted to receive said one arm of said carrier member.

3. An electrical double adaptor according to claim 1 wherein said opposed sets of grooves are only in the surfaces of said arms.

* * * * *